US005318458A

United States Patent [19]

Thörner

[11] Patent Number: 5,318,458

[45] Date of Patent: Jun. 7, 1994

[54] DEVICE FOR CONNECTING TO THE END OF A CABLE

[76] Inventor: Wolfgang B. Thörner, Hatzper Strasse 125, D-4300 Essen-Haarzopf, Fed. Rep. of Germany

[21] Appl. No.: 82,014

[22] Filed: Jun. 23, 1993

Related U.S. Application Data

[63] Continuation of Ser. No. 817,764, Jan. 9, 1992, abandoned.

[30] Foreign Application Priority Data

Jan. 11, 1991 [DE] Fed. Rep. of Germany ..... 4100600
Dec. 6, 1991 [DE] Fed. Rep. of Germany ..... 4140227

[51] Int. Cl.[5] ..... H01R 13/00
[52] U.S. Cl. ..... 439/427; 439/584
[58] Field of Search ..... 439/427, 428, 578-585

[56] References Cited

U.S. PATENT DOCUMENTS

| | | | |
|---|---|---|---|
| 3,184,706 | 5/1965 | Atkins | 439/584 |
| 3,292,136 | 12/1966 | Somerset | 439/584 |
| 3,354,420 | 11/1967 | Mineck | 439/584 |
| 3,526,871 | 9/1970 | Hobart | 439/584 |
| 4,352,240 | 10/1982 | Komada | 439/427 |

FOREIGN PATENT DOCUMENTS

| | | | |
|---|---|---|---|
| 119029 | 3/1970 | Fed. Rep. of Germany | 439/427 |
| 1285750 | 1/1962 | France | 439/427 |
| 239880 | 3/1946 | Switzerland | 439/427 |
| 612213 | 11/1948 | United Kingdom | 439/427 |

*Primary Examiner*—Joseph H. McGlynn
*Attorney, Agent, or Firm*—Collard & Roe

[57] ABSTRACT

A device for connecting to the end of a cable, having stranded wires including a sleeve nut. The sleeve nut has threads at one end. The cable is placed through the sleeve nut with the threads facing towards the end of the cable. A sleeve is provided with gripping means. The cable is placed through the sleeve after the sleeve nut. The gripping means are in contact with the outer insulated surface of the cable and prevent the cable from sliding out of the sleeve. An outer support ring having threads and including a pointed contact is provided. The pointed contact penetrates the stranded wires of the cable as the sleeve nut threads and the outer support ring threads engage and are rotated. This causes the sleeve nut and the outer support ring to move together, radially compressing the sleeve, so that the gripping means prevent the cable from sliding out of the sleeve.

6 Claims, 2 Drawing Sheets

DEVICE FOR CONNECTING TO THE END OF A CABLE

This is a continuation of copending application Ser. No. 07/817,764 filed on Jan. 9, 1992, now abandoned.

BACKGROUND OF THE INVENTION

1. Field of the Invention

The invention relates to a device for connecting the end of a cable to a plug, a jack or an electrical device. More particularly, the device has at least one terminal contact which has a sharpened end which penetrates into the stranded wires of the cable. The device also includes a sleeve into which the cable is inserted. The sleeve is radially compressed to prevent the cable from being removed from the connection device.

2. Description of the Prior Art

Such a device is known, for example, from German Patent DE-OS 25 10 299. In this known device, a complicated special tool is needed to produce the connection. The special tool presses the cable end against the plug element and holds it in place. The terminal contact is made during a subsequent work step, by a sharpened metallic contact, which is screwed through the plug element into the cable end by another separate screwdriver-type tool. Finally, in the last work step, the sleeve is pressed over the contact point by means of a hexagonal press. The known device therefore requires several special tools for making a connection to a cable end, and several consecutive work steps.

A similar device is also known from German Patent DE-GM 79 03 554. However, this patent does not show a sleeve which can be squeezed radially to hold the cable in place. Instead, radial pressure forces are exerted on the outside insulation of the cable end by the housing of the plug element. In this device, the bluntly cut cable end must first be pushed by hand onto the sharpened contact or contacts. Subsequently, the housing, which is divided into half sections, is placed around the cable end, and pressed together with great force, in order to generate the required radial pressure forces. In this connection, special care is necessary to ensure that the terminal contacts, which are at first only loosely inserted in the cable end, do not slip out of the cable end before the necessary force is exerted by the housing. If this is not done carefully, the quality of the terminal contact produced in this way can be compromised.

SUMMARY OF THE INVENTION

It is, therefore, an object of the present invention to eliminate the afore-mentioned drawbacks of the prior art and to provide a connection device which is securely attached to the cable.

It is a further object of the present invention to provide such a device which guarantees the electrical connection between the two items being connected.

It is yet another object of the invention to provide a device which can be simply installed by hand.

These and other related objects are attained according to the invention by a device for connecting to the end of a cable having stranded wires. The device includes a sleeve nut having threads at one end. The cable is placed through the sleeve nut with the threads facing toward the end of the cable. Also, a sleeve having gripping means is provided. The cable is placed through the sleeve after placement through the sleeve nut. The gripping means are in contact with the outer insulated surface of the cable and prevent the cable from sliding out of the sleeve. An outer support ring is provided which has threads and includes a pointed contact. The pointed contact penetrates the stranded wires of the cable as the sleeve nut thread and the outer support ring threads engage and are rotated. This also causes the sleeve nut and the outer support ring to move together, radially compressing the sleeve, so that the gripping means prevent the cable from sliding out of the sleeve.

The sleeve can be provided with one or more longitudinal slits. Alternatively, the sleeve may be made from compressible material. In this manner, when the outer support ring is rotated onto the sleeve nut, the sleeve is able to compress onto the cable.

The gripping means may include serrations which increases the friction between the sleeve and the cable.

The pointed contact may advantageously have sawtooth profiling along its length.

The device may also be attached to the end of a coaxial cable. In this situation, the outer support ring additionally includes a cylindrical blade contact which concentrically surrounds the pointed contact. The diameter of the cylindrical blade contact corresponds to the diameter of the outer conductor of the coaxial cable. The pointed contact projects beyond the cylindrical blade contact.

The device may also be connected to the end of a coaxial cable which includes a third outside conductor. This third outside conductor acts as a shield for the other two conductors. The sleeve nut can be provided with a threaded bore which is oriented perpendicular to the coaxial cable. A screw can be screwed into this threaded bore to contact the third outside conductor.

The device according to the invention is characterized, first of all, by a particularly easy assembly without any special tools. For assembly, the threaded sleeve nut and the sleeve are set onto the bluntly cut cable end. Subsequently, the sleeve nut, the sleeve and the cable are pushed axially over the electrical terminal contacts. The great force in the axial direction which is required for this axial movement is generated exclusively by the threads between the sleeve nut and support ring. During this process, the terminal contact, which is sharpened at the front, penetrates into the stranded wires of the cable end and produces electrical contact with it. When the terminal contact penetrates, the insulation material of the cable is displaced radially outward. Because of this, radial pressure stress builds up within the sleeve. Because of this pressure stress, the outside insulation of the cable lies against the inside wall of the sleeve, so that an intimate bond between the sleeve and the outside insulation is formed. At the same time, the sleeve is radially compressed by the support ring which surrounds it, in one and the same work process. The pressure stresses within the sleeve, which are further increased by this, generate strong clamping forces between the terminal contact and the stranded wire which remains tightly connected. Because the sleeve is constantly supported against the support ring, which surrounds it, it cannot expand back.

A particular advantage also consists of the fact that the electrical contact is produced within the insulation, which is under great radial pressure stress, so that the contact points are hermetically surrounded by the insulation material, to the greatest extent possible. As a result, the electrical contacts produced in this way are sealed securely against corrosive atmospheric influences, so that contact defects due to contact corrosion are permanently avoided.

The device can be advantageously used for coaxial cables, in which making connections is normally very labor-intensive, because of the large number of contacts to be produced. The assembly effort for connecting the end of a coaxial cable is not at all different from the assembly effort for a normal, solid conductor cable. In the use of the combination pointed/blade contact, the pointed contact projects beyond the sharpened end of the blade contact with its pointed end. This simplifies introduction of the pointed contact into the inside conductor braid and gives the cable end guidance in the longitudinal direction of the blade contact, even before penetration of the blade contact.

BRIEF DESCRIPTION OF THE DRAWINGS

The above and other objects, advantages and features of the invention will become more apparent from the following detailed description of preferred embodiments, taken in conjunction with the accompanying drawing wherein.

DETAILED DESCRIPTION OF PREFERRED EMBODIMENTS

Figure 1:
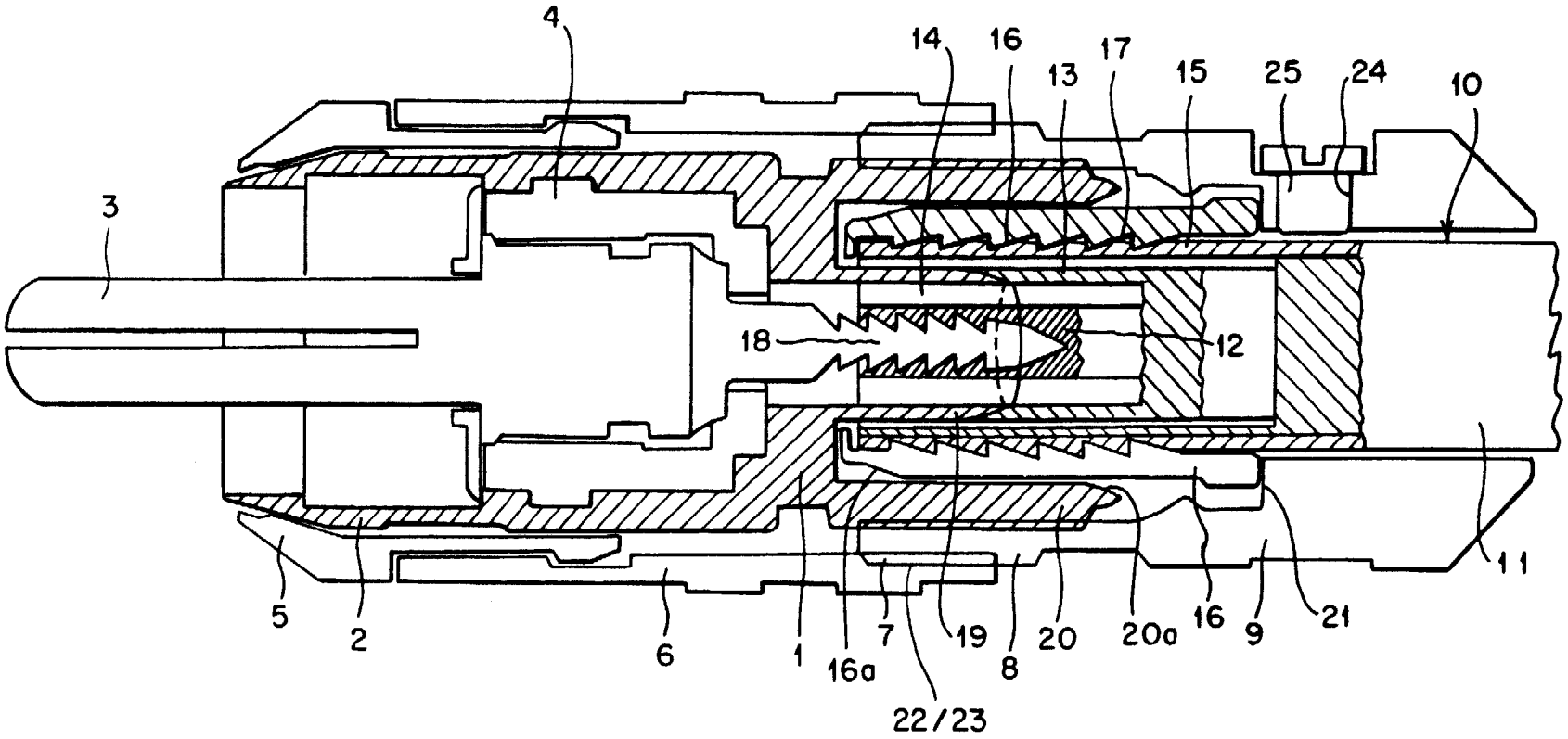
FIG. 1 is a longitudinal cross-sectional view of a connection device embodying the present invention.

Referring now in detail to the drawings and, in particular, to FIG. 1, there is illustrated a connection device consisting of a metallic plug element 1, commonly known as an RCA jack, which is provided with a cylindrical contact 2 and a contact pin 3 on the plug side, electrically insulated from each other by an insulated sleeve 4. The cylindrical or outside ring contact 2 is conically shaped on its outside, and is divided into several tongues by means of longitudinal slits, as is conventional. These tongues can be pressed together like a vise grip mechanism. During compression, a support ring 5 is used which rests against an outer cone surface 40 of cylindrical contact 2. Support ring 5 is mounted at the front end of a mantle sleeve 6 which surrounds plug element 1. Mantle sleeve 6 is rotatably mounted on sleeve nut 9 by means of an inside thread 7 of mantle sleeve 6, which engages an outside thread 8 at the outside circumference of sleeve nut 9. Rotating mantle sleeve 6 causes axial movement of mantle sleeve 6 and support ring 5 which is attached to mantle sleeve 6. As support ring 5 moves towards the cable end of plug element 1, the tongues of cylindrical contact 2 move closer together, for example.

On the cable connection side, sleeve nut 9 is provided with an opening 10 for passage of a coaxial cable 11. Coaxial cable 11 includes a central conductor 12 composed of stranded wires, and an outside conductor 13, which can consist of a fine wire mesh and may serve as a shield for central conductor 12, for example. Between central conductor 12 and outside conductor 13, there is an insulated layer 14, which consists of a suitable plastic with dielectric properties, for example. On its outside, outside conductor 13 is surrounded by an outside insulation 15, which also consists of a suitable plastic, for example.

Between outside insulation 15 and outside conductor 13, an additional shield layer 13*a* can be embedded, which provides additional shielding against magnetic interference and can consist of a suitable metal foil for this purpose.

The end of coaxial cable 11 is cut perpendicular to the longitudinal axis of the cable and is inserted into sleeve nut 9 and a sleeve 16 which lies against outside insulation 15 and is provided with serrations 17 which increase the friction and provide traction so that cable 11 is held in place. Plug element 1 is provided with a shaft 18 at the center, the longitudinal axis of which coincides with the longitudinal axis of coaxial cable 11, and the tip of which points in the direction of coaxial cable 11 to be connected. Pointed contact 18 has a saw-tooth profile along its length and is electrically connected with contact pin 3. Pointed contact 18 is surrounded by a cup-shaped or ring-shaped blade contact 19, the sharpened side of which also faces coaxial cable 11 to be connected. The diameter of the cup or ring approximately corresponds to the diameter of outside conductor 13 of coaxial cable 11. Blade contact 19 is electrically connected with outside ring contact 2. Thus, pointed contact 18 and ring-shaped blade contact 19 are configured and designed so that pointed contact 18 can contact central conductor 12 while ring-shaped blade contact 19 can contact outside conductor 13. Sleeve 16, which provides traction for cable 11, includes a conical surface 16*a* at its front end which rests against an outer support ring 20 which is connected in one piece with the plug element 1. Support ring 20 also has a conical surface 20*a* for meeting and facilitating the sliding motion past cone surface 16*a* of sleeve 16.

Sleeve 16 is structured to be radially deformable by being provided with one or more longitudinal slits or being made from a correspondingly deformable material, for example. Sleeve 16 rests against a shoulder 21 of sleeve nut 9 at its rear end. Sleeve nut 9 is provided with an inside thread 22 which engages an outside thread 23 of plug element 1.

For assembly, coaxial cable 11 is first cut off smoothly, perpendicular to its longitudinal axis. Then sleeve nut 9 is pushed onto the end of the coaxial cable in such a way that its threads point toward the cut end of the cable. Subsequently, sleeve 16 is pushed over the smoothly cut end of coaxial cable 11 into sleeve nut 9 until shoulder 21 is reached. Sleeve nut 9 and sleeve 16, together with coaxial cable 11, are pushed in the direction of pointed/blade contact arrangement 18, 19 until conical surface 16*a* of sleeve 16 rests against conical surface 20*a* of support ring 20. Subsequently, sleeve nut 9 is screwed onto support ring 20 by engagement of threads 22 and 23. When sleeve nut 9 is screwed onto support ring 20, sleeve 16 is pushed over pointed/blade contact arrangement 18, 19 by shoulder 21 of sleeve nut 9, with great force. When this happens, pointed contact 18 first penetrates into the threaded wires of central conductor 12 of coaxial cable 11 with its tip and produces an electrical contact there. In the same manner, blade contact 19 penetrates into the end of coaxial cable 11 in the area of outside conductor 13 with its sharpened end and produces an electrical terminal contact with outside conductor 13. At the same time, sleeve 16 is radially compressed by the axial displacement as cone surfaces 16*a* and 20*a* slide past each other so that the end of coaxial cable 11 located within sleeve 16 is compressed. This compressive force increases the intensity of the electrical terminal contacts and seals the contact points hermetically against the external environment. In other words, as sleeve nut 9 and support ring 20 are screwed together, support ring 20 acts as a wedge and causes sleeve 16 to be compressed onto cable 11.

A coaxial cable 11 with a third outside conductor 13a can also be used. Conductor 13a may serve to shield the other conductors or serve as a ground connection. If the outer outside conductor 13a is supposed to be contacted, a threaded passageway 24 is provided in sleeve nut 9, in the area of coaxial cable 11, running perpendicular to coaxial cable 11. A screw 25 can be screwed into threaded passageway 24. Screw 25 penetrates insulation 15 of coaxial cable 11 with its point, and thus produces an electrical contact between sleeve nut 9 and additional outside conductor 13a, if needed. Sleeve nut 9 is, of course, electrically connected with plug element 1 via threads 22 and 23.

Once the terminal contacts are secure, plug element 1 can be attached to a corresponding jack and mantle sleeve 6 can be rotated to clamp cylindrical contact 2 to the outer surface of the corresponding jack.

Figure 2:
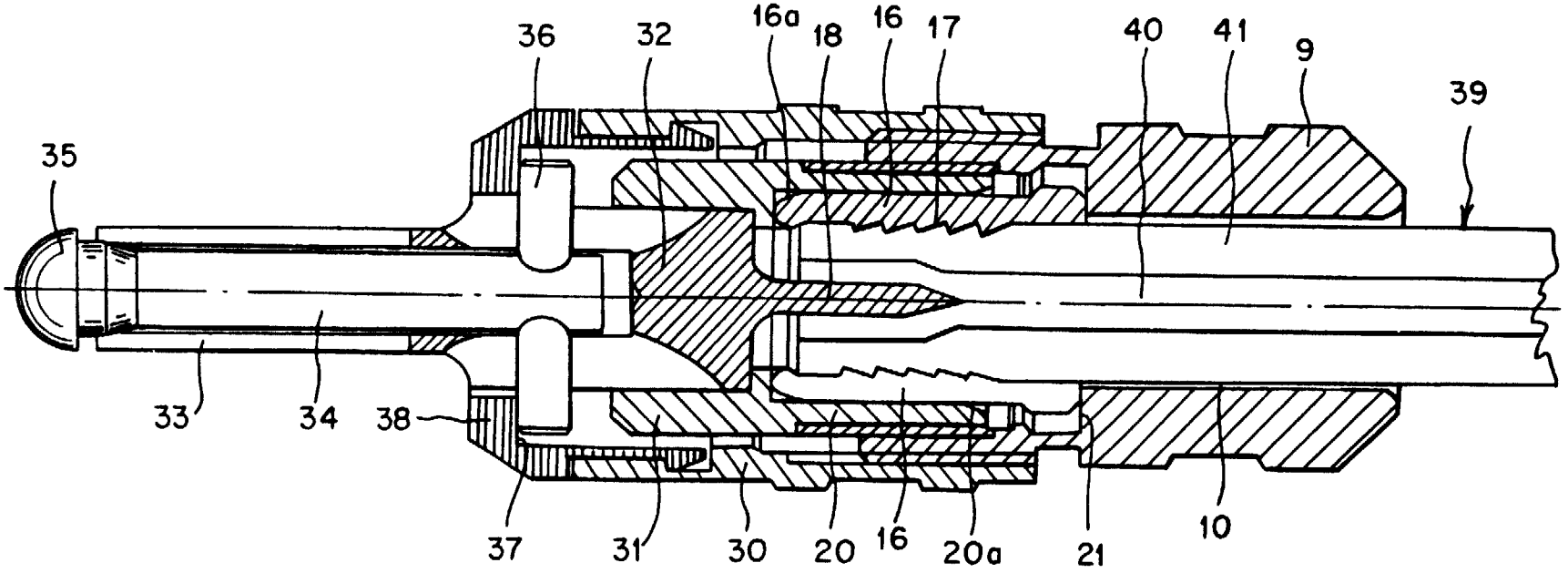
FIG. 2 is a longitudinal cross-sectional view of an alternate embodiment of the connection device.

The embodiment according to FIG. 2 shows a banana-type or phono-type plug which has a conventional structure on the left or plug side. The outside surface of the banana-type plug is provided with an insulated handle sleeve 30 which surrounds an internal metallic plug element 31. Plug element 31 contains a metallic contact piece 32 which is connected with metallic plug pin 33 of the banana plug at its front end. Plug pin 33 is hollow and can be spread open by means of a spreading mechanism. This spreading mechanism consists of a traction bolt 34 arranged on the inside of plug pin 33 which has a conical spreader head 35 at its outer end and cross-bolts 36 at its plug-side end. Cross bolts 36 rest against screw surfaces 37 of a rotating sleeve head 38 which is mounted to rotate on the front end of handle sleeve 30. Sleeve head 38 and handle sleeve 30 are made of insulated material. Screw surfaces 37 of sleeve head 38 run at such an angle relative to the axial direction that when sleeve head 38 is rotated, a traction bolt 34 and spreader head 35 are retracted in the direction of cable 39 which causes plug pin 33 to be spread open further, and fixed in place in the female jack.

On the cable connection side, the banana plug according to FIG. 2 is structured as similarly as possible to the RCA plug shown in FIG. 1. Therefore, the same reference symbols are used for corresponding parts.

For the banana plug, also, a sleeve nut 9 is provided which can be screwed onto a plug element 31 by means of corresponding threads 22, 23 and has an outside thread 8 on the outside circumference onto which handle sleeve 30 can be screwed with its threads 7.

On the cable connection side, sleeve nut 9 is provided with an opening 10 for passage of cable 39. Cable 39 has a single conductor 40 consisting of stranded wires. Conductor 40 is in the central part of the cable and is surrounded by an outside insulation 41 consisting of plastic.

The connection-side end of cable 39 is cut off perpendicular to the longitudinal axis of the cable and is surrounded by a sleeve 16 which rests against outside insulation 41. Sleeve 16 is provided with serrations 17 which increase the friction on the inside between sleeve 16 and cable 39 and provide traction so the wire is held in place. Contact piece 32 arranged at plug element 31 is provided with a shaft 18 at the center on the cable connection side, the longitudinal axis of which coincides with the longitudinal axis of cable 39, and the tip of which points in the direction of cable 39 to be connected.

Sleeve 16, which provides traction, includes a conical surface 16a at its front end, and rests against a corresponding conical surface 20a of an outer support ring 20. Support ring 20 is formed as one piece with plug element 31. Furthermore, sleeve 16 is structured to be radially deformable, either by providing one or more longitudinal slits, or being made from a correspondingly deformable material, for example. Sleeve 16 rests against a shoulder 21 of sleeve nut 9 with its rear end.

For assembly, the end of cable 39 is first cut off smoothly, perpendicular to its longitudinal axis. Sleeve nut 9 is pushed onto the end of cable 39 in such a way that its threads point toward the cut end of cable 39. Subsequently, sleeve 16 is pushed over the smoothly cut end of cable 39 until it hits shoulder 21. Sleeve nut 9 and sleeve 16, together with cable 39, are pushed toward pointed contact 18 until conical surface 16a of sleeve 16 rests against conical surface 20a of support ring 20. Subsequently, sleeve nut 9 is screwed onto plug element 31. This causes sleeve 16, together with cable 39 inside it, to be pushed onto pointed contact 18 with great force and, at the same time, to be deformed radially inward so that very great pressure stress builds up. Stranded wires of conductor 40 are compressed against pointed contact 18 which produces an intense electrical terminal contact and seals the contact point off against the external environment.

What is claimed is:

1. A device for connecting to the end of a electrical coaxial cable having stranded wires centrally located within a outer conductor and surrounded by an outer insulated sheath comprising:

a hollow cylindrical sleeve nut having an internal threads disposed within said sleeve nut terminating in a shoulder, said shoulder having a diameter smaller than said threads, said sleeve nut adapted to receive the cable through the shoulder end of said sleeve nut;

a cylindrical sleeve having internal gripping means and a diameter larger than said shoulder, the free end of the cable being placed through said sleeve with said sleeve abutting said shoulder and being located radially inwardly from said threads, said gripping means being in contact with the outer insulated sheath to prevent the cable from sliding out of said sleeve; and a cylindrical plug having external threads adapted to cooperate with said sleeve nut threads and including a centrally disposed contact pin electrically insulated from said cylindrical plug and a pointed contact coupled to said contact pin, said pointed contact having saw-tooth profiling along its length, and a cylindrical blade contact that concentrically surrounds said pointed contact, the diameter of the cylindrical blade contact corresponding to the diameter of the outer conductor of the coaxial cable, said pointed contact projects beyond said cylindrical blade contact, so that said sleeve nut threads and said plug threads rotatably engage to wedge said cylindrical plug between said sleeve nut and said sleeve, radially compressing said sleeve and said gripping means to prevent the end of the cable from sliding out of said sleeve while said pointed contact simultaneously penetrates the stranded wires, whereby the compressive force of said sleeve increases the intensity of the electrical terminal contacts against said pointed contact with saw-tooth profiling along its length and seals the contact points hermetically against the external environment.

2. The device according to claim 1, wherein said sleeve is provided with one or more longitudinal slits.

3. The device according to claim 1, wherein said sleeve is made from compressible material.

4. The device according to claim 1, wherein said gripping means includes serrations which increase the friction between said sleeve and the cable.

5. The device according to claim 1, wherein the coaxial cable includes a third outside conductor, said sleeve nut additionally having a threaded bore which is oriented perpendicular to the coaxial cable into which a screw can be screwed to contact the third outside conductor.

6. A device for connecting to the end of a straight cut electrical cable having stranded wires centrally located within an outer insulated sheath comprising:

a hollow cylindrical sleeve nut having internal threads disposed within said sleeve nut terminating in a shoulder, said shoulder having a diameter smaller than said threads, said sleeve nut adapted to receive the cable with the outer insulated sheath through the shoulder end of said sleeve nut;

a cylindrical sleeve having internal gripping means and a diameter larger than said shoulder, the free end of the cable with the outer insulated sheath being placed through said sleeve with said sleeve abutting said shoulder and being located radially inwardly from said threads, said gripping means being in contact with the outer insulated sheath to prevent the cable from sliding out of said sleeve, said cylindrical sleeve including a conical outer surface disposed radially outwardly from the free end of the cable; and a cylindrical plug separate from said cylindrical sleeve, said plug having a conical inner surface and external threads adapted to cooperate with said sleeve nut threads and including a centrally disposed contact pin electrically insulated from said cylindrical plug and a pointed contact coupled to said contact pin, so that said sleeve nut threads and said plug threads rotatably engage to slide said conical inner surface past said conical outer surface and wedge said cylindrical plug radially between said sleeve nut and said sleeve, radially compressing said sleeve and said gripping means to prevent the free end of the cable from sliding out of said sleeve while said shoulder pushes said sleeve and cable over said pointed contact, wherein said pointed contact penetrates the stranded wires.

* * * * *